US008590801B2

(12) United States Patent
Moran et al.

(10) Patent No.: US 8,590,801 B2
(45) Date of Patent: Nov. 26, 2013

(54) CASCADING SET POINT BURNER CONTROL SYSTEM FOR PAINT SPRAY BOOTHS

(75) Inventors: Ryan Moran, Dublin, OH (US); Mike Sakich, Powell, OH (US)

(73) Assignee: Honda Motor Co., Ltd., Tokyo (JP)

( * ) Notice: Subject to any disclaimer, the term of this patent is extended or adjusted under 35 U.S.C. 154(b) by 782 days.

(21) Appl. No.: 12/820,826

(22) Filed: Jun. 22, 2010

(65) Prior Publication Data

US 2011/0311929 A1 Dec. 22, 2011

(51) Int. Cl.
*G05D 22/02* (2006.01)

(52) U.S. Cl.
USPC ..... 236/44 C; 62/176.6; 165/223

(58) Field of Classification Search
USPC ..... 236/44 C; 62/176.6; 165/222, 223; 432/29
See application file for complete search history.

(56) References Cited

U.S. PATENT DOCUMENTS

| | | | |
|---|---|---|---|
| 2,946,943 | A | 7/1960 | Nye et al. |
| 3,617,717 | A | 11/1971 | Smith |
| 4,173,924 | A | 11/1979 | Bradshaw |
| 4,367,787 | A | 1/1983 | Bradshaw |
| 4,404,451 | A | 9/1983 | Niikawa et al. |
| 4,430,698 | A | 2/1984 | Harris |
| 4,494,596 | A | 1/1985 | Bradshaw |
| 4,542,851 | A | 9/1985 | Itou |
| 4,687,686 | A | 8/1987 | Stofleth et al. |
| 4,729,294 | A | 3/1988 | Osawa et al. |
| 4,730,553 | A | 3/1988 | Osawa et al. |
| 4,731,547 | A | 3/1988 | Alenduff et al. |
| 4,795,088 | A | 1/1989 | Kobayashi et al. |
| 4,943,003 | A | 7/1990 | Shimizu et al. |
| 4,991,770 | A | 2/1991 | Bird et al. |
| 5,127,574 | A | 7/1992 | Mosser et al. |
| 5,173,118 | A | 12/1992 | Josefsson |
| 5,213,259 | A | 5/1993 | Stouffer |
| 5,264,014 | A | 11/1993 | Lannefors et al. |
| 5,270,952 | A | 12/1993 | Adams et al. |
| 5,301,101 | A | 4/1994 | MacArthur et al. |
| 5,346,128 | A | 9/1994 | Wacker |
| 5,408,838 | A | 4/1995 | Yaeger et al. |

(Continued)

FOREIGN PATENT DOCUMENTS

| | | | |
|---|---|---|---|
| JP | 9-38546 | A | 2/1997 |
| JP | 11-101485 | A | 4/1999 |

(Continued)

OTHER PUBLICATIONS

Honeywell, Specification, UDC 3300 Universal Digital Controller, 1999, 1 page, Industrial Automation and Control, Fort Washington, PA.

(Continued)

*Primary Examiner* — Marc Norman
(74) *Attorney, Agent, or Firm* — Standley Law Group LLP

(57) ABSTRACT

A system and method for controlling the temperature and humidity of ambient air entering an air supply unit at conditions falling within an atmospheric window to produce optimal temperature and humidity conditions inside a paint booth. The system includes a humidity control loop and a temperature control loop. The humidity control loop monitors the humidity within the paint booth, and directs the temperature control loop to increase the temperature within the paint booth when humidity therein is above a set value. The temperature and humidity within the paint booth are thus maintained within an optimal window.

20 Claims, 4 Drawing Sheets

(56) References Cited

U.S. PATENT DOCUMENTS

| | | | | |
|---|---|---|---|---|
| 5,460,569 | A | 10/1995 | Josefsson | |
| 5,554,416 | A | 9/1996 | Scheufler et al. | |
| 5,573,181 | A | 11/1996 | Ahmed | |
| 5,618,333 | A | 4/1997 | Buchholz et al. | |
| 5,746,650 | A | 5/1998 | Johnson et al. | |
| 5,819,845 | A | 10/1998 | Ryu et al. | |
| 5,915,473 | A | 6/1999 | Ganesh et al. | |
| 5,924,486 | A | 7/1999 | Ehlers et al. | |
| 6,010,562 | A | 1/2000 | Flynn et al. | |
| 6,129,285 | A * | 10/2000 | Schafka | 236/44 C |
| 6,240,324 | B1 | 5/2001 | Preska et al. | |
| 6,253,113 | B1 | 6/2001 | Lu | |
| 6,264,111 | B1 | 7/2001 | Nicolson et al. | |
| 6,269,274 | B1 | 7/2001 | Steinman et al. | |
| 6,502,629 | B2 | 1/2003 | Valachovic | |
| 6,508,303 | B1 | 1/2003 | Naderer | |
| 6,825,631 | B1 | 11/2004 | Nakamura | |
| 6,829,522 | B1 | 12/2004 | Filev et al. | |
| 6,926,079 | B2 | 8/2005 | Kensok et al. | |
| 7,059,536 | B2 | 6/2006 | Schneider et al. | |
| 7,155,318 | B2 | 12/2006 | Sharma et al. | |
| 7,310,572 | B2 | 12/2007 | Havlena et al. | |
| 7,346,467 | B2 | 3/2008 | Bohrer et al. | |
| 7,360,534 | B2 | 4/2008 | Krupp | |
| 7,389,813 | B2 | 6/2008 | Babikian et al. | |
| 2004/0215356 | A1 | 10/2004 | Salsbury et al. | |
| 2007/0066203 | A1 | 3/2007 | Melegatti | |
| 2008/0071395 | A1 | 3/2008 | Pachner | |
| 2008/0082312 | A1 | 4/2008 | Dash et al. | |
| 2008/0134098 | A1 | 6/2008 | Hoglund et al. | |
| 2008/0184991 | A1 | 8/2008 | Krupp | |
| 2008/0311836 | A1 | 12/2008 | Bhattacharya | |
| 2009/0109056 | A1 | 4/2009 | Tamarkin et al. | |
| 2009/0130317 | A1 | 5/2009 | Moore | |
| 2009/0210094 | A1 | 8/2009 | Boder et al. | |
| 2010/0070093 | A1 | 3/2010 | Harrod et al. | |

FOREIGN PATENT DOCUMENTS

| | | | |
|---|---|---|---|
| JP | 2000-310440 | A | 11/2000 |
| JP | 2003-50038 | A | 2/2003 |
| KR | 10-2006-0000653 | A | 1/2006 |
| KR | 10-0657431 | B1 | 12/2006 |

OTHER PUBLICATIONS

Honeywell, Product Information Note, Profit Controller Multivariable Control and Optimization Technology, Jul. 2007, 3 pages, Automation & Control Solutions, Phoenix, AZ.

* cited by examiner

CASCADING SET POINT BURNER CONTROL SYSTEM FOR PAINT SPRAY BOOTHS

TECHNICAL FIELD

Exemplary embodiments described herein relate generally to a system and method for controlling environmental conditions within a paint booth. More specifically, exemplary embodiments described herein relate to a system and method for controlling temperature and humidity within a paint booth.

BACKGROUND OF THE INVENTION

Methods used in conditioning air from one state to another state may vary widely depending on such factors as the quality of the air to be conditioned, the temperature and humidity to which the air must be conditioned, the volume of air to be conditioned, and whether a portion of the conditioned air will be outside air or recirculated air. In some applications only the temperature of the air is important whereas in other applications, the humidity of the air is more important.

The painting industry, and particularly the automotive painting industry, is one example where the humidity as well as the temperature of the air must be maintained within an optimal range of conditions. Typically in air supply units ("ASUs") for applying a base coat, ambient air enters the unit, passes through a pre-heat burner, and then passes through both a humidification media and cooling coils. After traversing the cooling coils, the air passes a reheat burner and is blown into the booth. The use of a reheat burner provides a good method for controlling both the temperature and humidity of the air delivered to the booth. However, typical clear coat ASUs are very poor at controlling humidity. Traditional clear coat ASUs are not equipped with re-heat burners, unlike most base coat ASUs. This lack of a re-heat burner results in poor humidity control year round, especially in the late summer when humidity is high. This is problematic because high humidity in a clear coat paint booth may result in quality and delivery problems. For example, high humidity may result in high voltage kick-outs, drips from buildup, gun spit rejects, solvent pop, and frequent line stops to wipe down the booth.

In clear coat ASUs lacking a re-heat burner, a single closed control loop is generally used. The single closed control loop consists of a burner which adds heat to the airstream, a temperature sensor that reports the booth temperature, and a proportional-integral-derivative ("PID") controller that makes adjustments to the control signal to track a fixed temperature set point. While this control loop allows for optimal temperature control in the clear coat booth, as the ambient humidity rises, the humidity in the clear coat booth may also rise to levels detrimental to proper clear coat application, thereby affecting productivity. Therefore, it is desirable to overcome the shortcomings of the traditional system and method of controlling only temperature inside a clear coat booth.

SUMMARY OF THE GENERAL INVENTIVE CONCEPT

Exemplary embodiments of the inventive concept are based upon the recognition that a humidity level above about 75% in a paint booth is detrimental to the application of solvent based paints. Exemplary embodiments described herein provide a system and method for controlling the humidity in a paint booth having an air supply unit without a re-heater during specific atmospheric conditions. Embodiments of the present invention improve the quality of paint delivery by controlling humidity, while also reducing costs as compared to alternative for humidity control techniques.

Generally, embodiments of the present invention provide an air supply unit for forcing air into a paint booth. The air supply unit includes a pre-heat burner for heating air entering the air supply unit. The pre-heat burner is controlled by a temperature PID controller. A temperature sensor is also located in the air supply unit so as to monitor the temperature within the paint booth. The temperature sensor is in communication with the temperature PID controller.

A humidity PID controller is also provided. The humidity PID controller is in electrical communication with at least a humidity sensor positioned within the air supply unit to monitor the humidity within the paint booth. The humidity PID controller is also in electrical communication with the temperature PID controller. When the humidity PID controller detects that humidity in the paint booth is above about 75%, it sends an adjusted temperature set point to the temperature PID controller. The temperature PID controller then increases the output of the pre-heat burner to increase the temperature inside the paint booth in order to decrease the humidity therein. The humidity PID controller continues to send adjusted temperature set points to the temperature PID controller to compensate for the humidity in the paint booth, causing the temperature to be increased and decreased so as to maintain optimal humidity while also providing minimal utility use. Although the humidity PID controller provides the adjusted temperature set points, the temperature PID controller prevents the temperature within the paint booth from rising above 75° F., as this would be detrimental to paint application.

BRIEF DESCRIPTION OF THE DRAWINGS

In addition to the features mentioned above, other aspects of the inventive concept will be readily apparent from the following descriptions of the drawings and exemplary embodiments, therein like reference numerals across the several views refer to identical or equivalent features, and wherein.

DETAILED DESCRIPTION OF THE EXEMPLARY EMBODIMENT(S)

The present inventive concept will now be described more fully hereinafter with reference to the accompanying drawings, in which some, but not all possible embodiments of the invention are shown. Indeed, these inventions may be embodied in many different forms and should not be construed as limited to the embodiments set forth herein.

Figure 1:
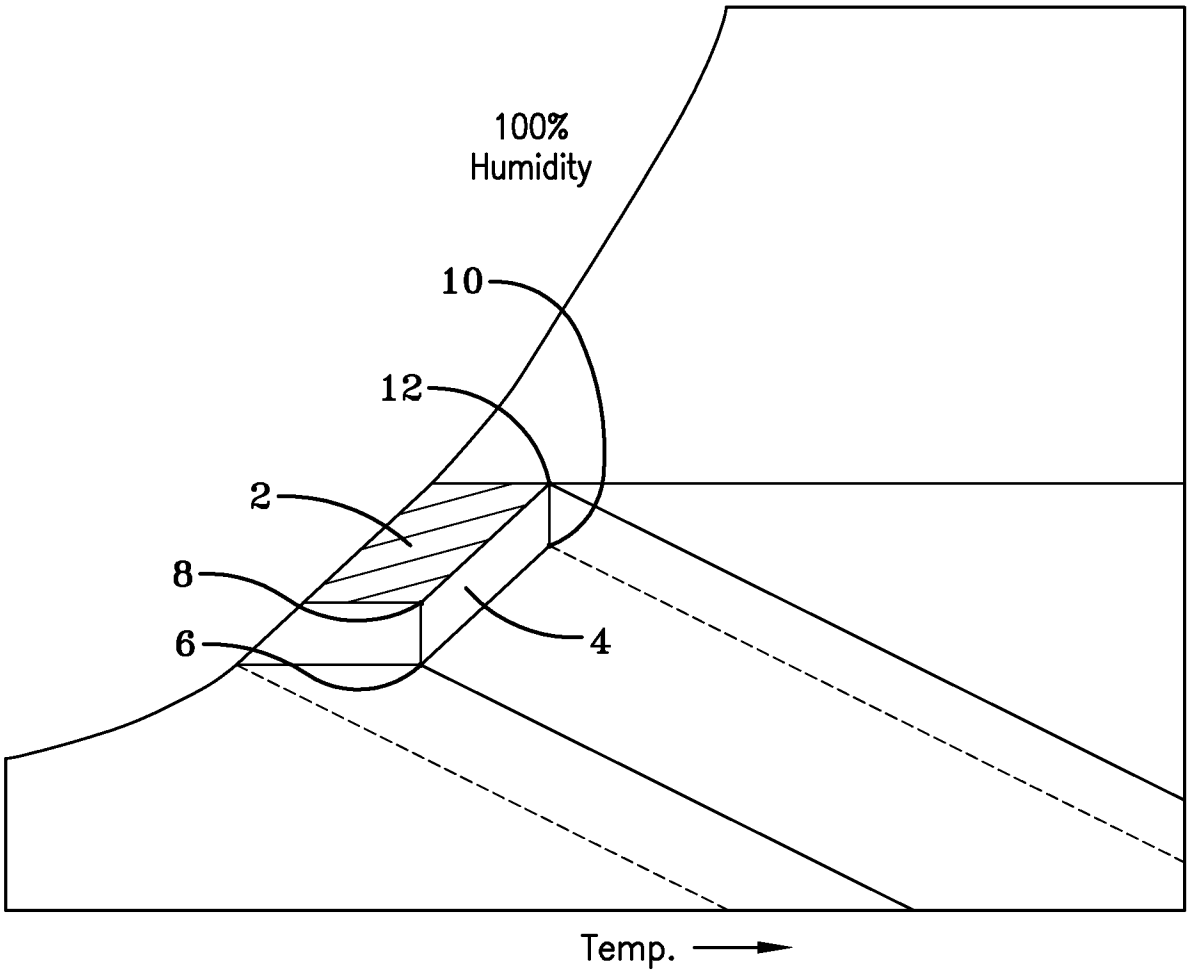
FIG. 1 is a simplified psychrometric chart illustrating the atmospheric window and optimal window.

FIG. 1 is a simplified psychrometric chart illustrating an atmospheric window 2 (hatched portion) and the optimal window 4. The atmospheric window 2 represents the ambient atmospheric conditions at which exemplary embodiments of the inventive concept are effective at providing an optimal window 4 wherein the temperature and humidity levels inside the paint booth are conducive for the application of clear coat. Exemplary embodiments of the system and method are extremely useful for painting applications located where the outside air temperature is within the atmospheric window 2 and where the air within the paint booth is required to be within the range of parameters defined by the optimal window 4. Typically the conditions defined by the atmospheric window 2 are found in late summer and early fall, and account for 18% to 20% of the climate experienced in any given year.

The optimal window 4 is defined by a first point 6 located at approximately 65° F. and 65% humidity, a second point 8 located at approximately 65° F. and 75% humidity, a third point 10 located at approximately 75° F. and 65% humidity, and a fourth point 12 located at approximately 75° F. and 75% humidity. The atmospheric window 2 represents the range of ambient air temperatures for which heating may be used to maintain the humidity inside the booth within the optimal window 4 while also maintaining the temperature within the optimal window.

Figure 2:
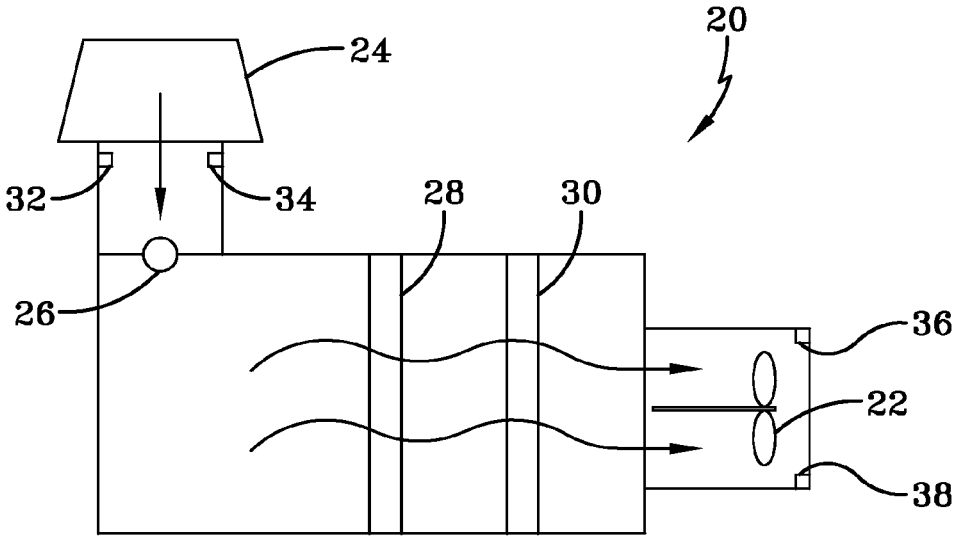
FIG. 2 is an illustration of a typical clear coat air supply unit for use with the exemplary embodiments of the present invention.
Figure 3:
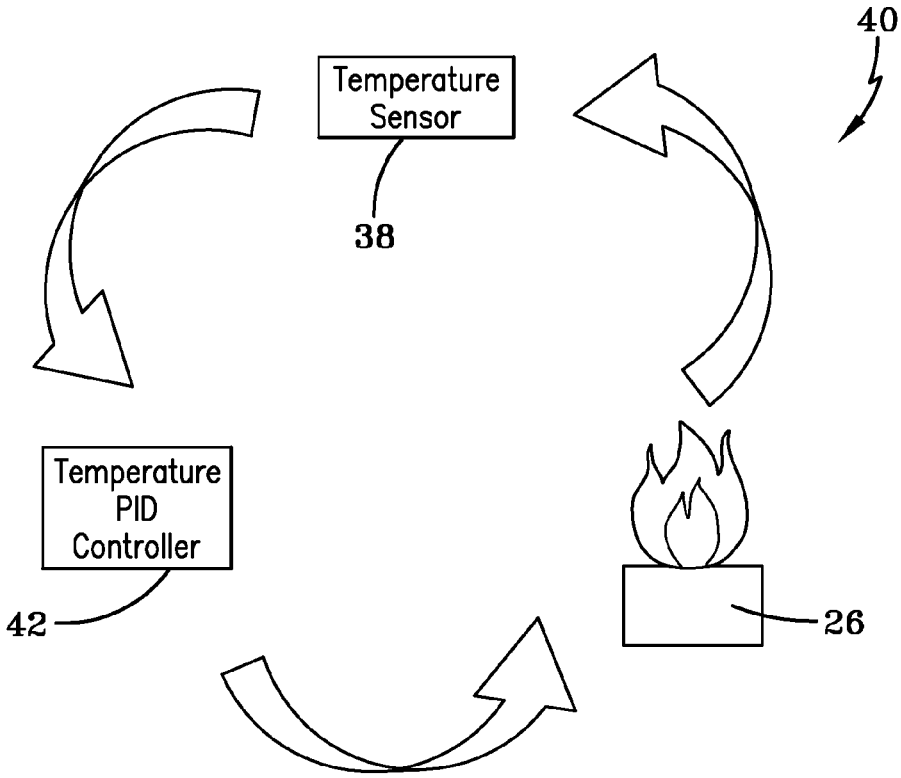
FIG. 3 is a diagram illustrating a traditional temperature control loop for a clear coat air supply unit.

To better understand the present invention, a typical clear coat ASU 20 is illustrated in FIG. 2 and a traditional control loop 40 for the clear coat ASU 20 is illustrated in FIG. 3. As illustrated in FIG. 2, ambient air is drawn into the clear coat ASU 20 by a fan 22 through an inlet 24. Near the inlet 24, a pre-heat burner 26 is provided to heat the incoming ambient air. After the pre-heat burner 26, the air passes through a humidification media 28 and cooling coils 30. Once the air has cleared the cooling coils 30 it is expelled by the fan 22 from the clear coat ASU 20 into the clear coat paint booth. The clear coat ASU may also have an inlet humidity sensor 32, and inlet temperature sensor 34, an outlet humidity sensor 36, and an outlet temperature sensor 38. The inlet sensors 32, 34 monitor the ambient air entering the clear coat ASU and the outlet sensors 36, 38 monitor the air entering the paint booth. The lack of a re-heat burner located between the cooling coils 30 and fan 22 in most clear coat ASUs results in poor humidity control within the paint booth. Nonetheless, due to cost and the fact that clear coats are solvent based, and thus have less demanding humidity tolerances, typical clear coat ASUs 20 are not equipped with a re-heat burner.

The pre-heat burner 26 in the clear coat ASU 20 is controlled by a temperature control loop 40 as shown in FIG. 3. The temperature control loop 40 includes the pre-heat burner 26 for heating the ambient air before it enters the booth, the outlet temperature sensor 38, and a temperature PID controller 42 in communication with both the outlet temperature sensor and the pre-heat burner. The temperature PID controller 42 is programmed to use paint booth temperature readings from the outlet temperature sensor 38 and make adjustments to the control signal sent to the pre-heat burner 26 to track the pre-programmed, fixed temperature set point. Although the temperature control loop 40 is effective for a portion of atmospheric conditions, it is ineffective at maintaining both the temperature and humidity within the optimal window 4 inside the clear coat paint booth when the outside environment is within the atmospheric window 2.

Figure 4:
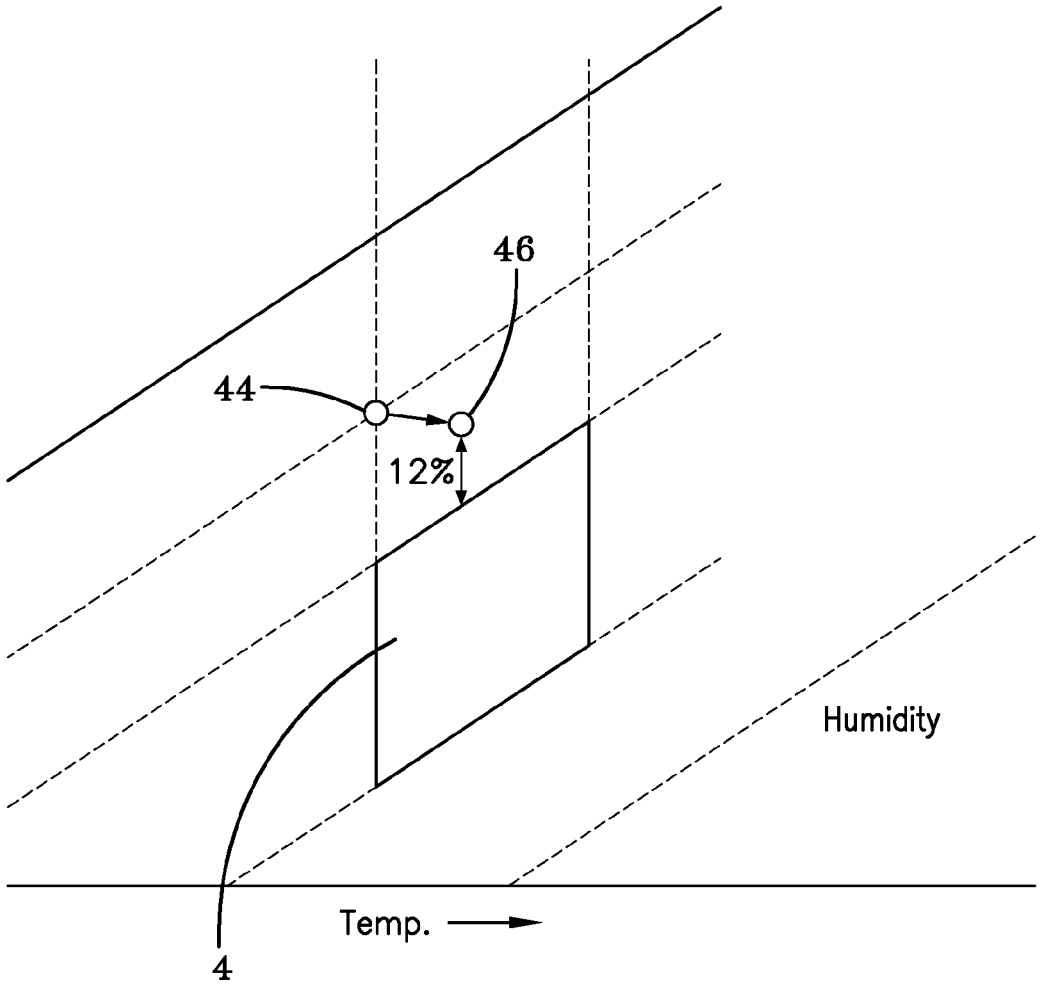
FIG. 4 is a simplified psychrometric chart illustrating the ineffectiveness of traditional temperature control loops in dealing with high humidity.

The ineffectiveness of a traditional temperature control loop 40 is illustrated in the simplified psychrometric chart illustrated in FIG. 4. As shown in FIG. 4, the outside ambient air condition 44 is measured to be 66° F. and 90% humidity, which falls within the atmospheric window 2. The temperature control loop 40 is set to a fixed temperature of about 71° F. in the clear coat paint booth. This results in a paint booth air condition 46 having a temperature of about 71° F. and humidity of about 87%. This represents a humidity within the paint booth that is unacceptably high by approximately 12%, as indicated by the distance from the optimal window 4.

Figure 5:
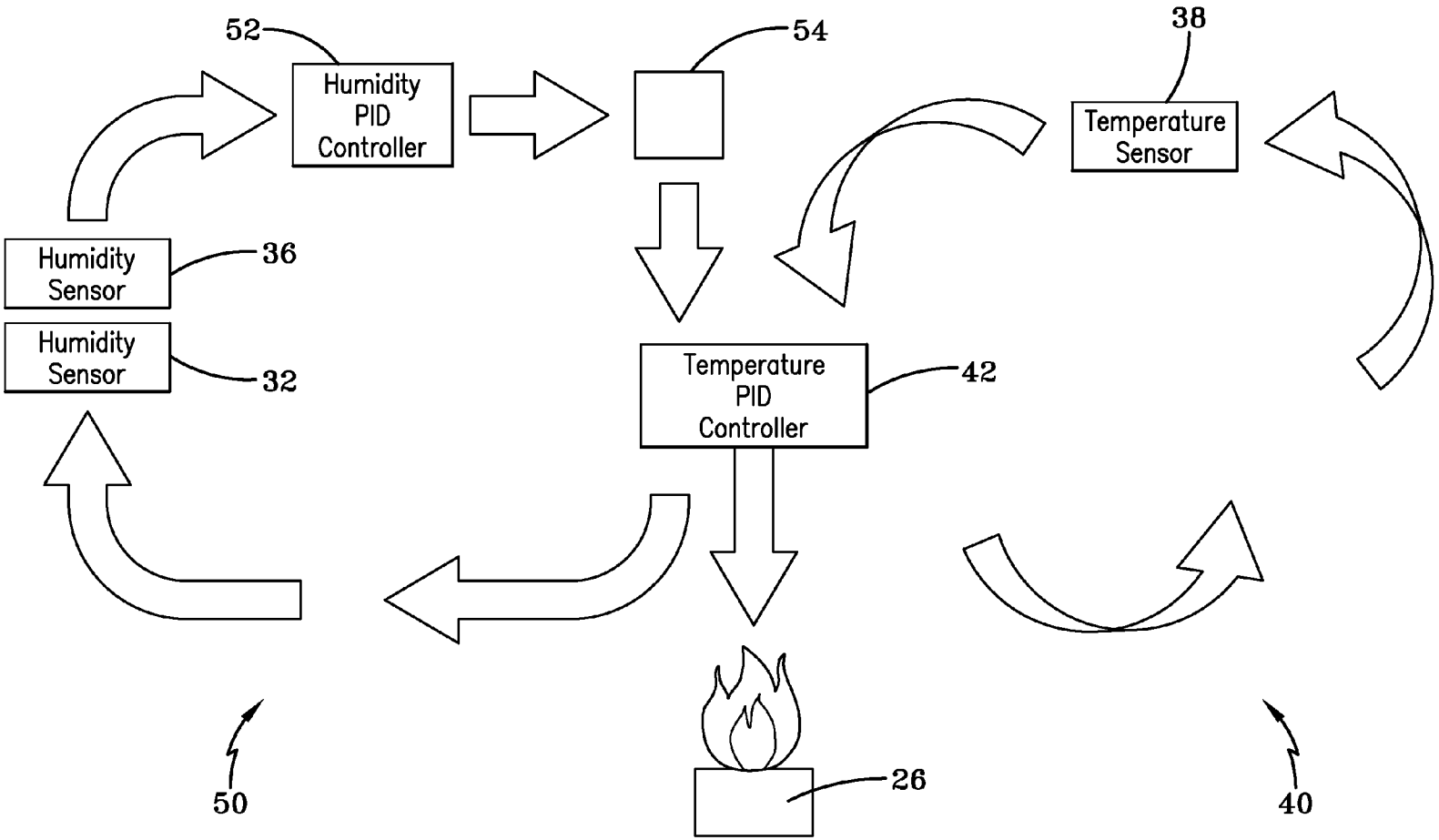
FIG. 5 is a diagram illustrating an exemplary embodiment of the inventive concept where a humidity control loop and a temperature control loop of an air supply unit are placed in communication to control the temperature and humidity within an associated paint spray booth.

Exemplary embodiments of the inventive concept allow for control over both the humidity and temperature within the paint booth with a clear coat ASU 20 when the ambient air is within the atmospheric window 2. As shown in FIG. 5, an exemplary embodiment of the present invention incorporates a humidity control loop 50 with the traditional temperature control loop 40. The humidity control loop 50 includes the inlet and outlet humidity sensors 32, 36 wherein both sensors are in communication with a humidity PID controller 52. The humidity PID controller 52 is also in communication with the temperature PID controller 42 by way of a switch 54. The switch 54 allows communication between the humidity PID controller 52 and the temperature PID controller 42 under preprogrammed conditions, such as when the humidity PID controller 52 detects a humidity outside the optimal window 4. The inlet humidity sensor 32 monitors the ambient air humidity as it enters the clear coat ASU 20. The outlet humidity sensor 36 monitors the air exiting the clear coat ASU 20. The humidity sensors 32, 36 transmit the humidity data to the humidity PID controller 52.

To provide both humidity and temperature control inside the clear coat paint booth the humidity PID controller 52 analyzes the humidity data from the outlet humidity sensor 36 to determine the humidity in the paint booth. If the humidity is above the optimal window 4, as detected by the outlet sensor 36, the humidity PID controller 52 transmits a new temperature set point to the temperature PID controller 42, overriding the original temperature set point. The temperature PID controller 42 then directs the pre-heat burner to increase the temperature of the incoming air to decrease the humidity. The humidity PID controller 52 continues to monitor the humidity in the paint booth and continuously sends updated temperature set points to the temperature PID controller 42. Although the humidity PID controller 52 causes an increase in temperature to compensate for the humidity, the temperature PID controller 42 prevents the temperature within the paint booth from exceeding the optimal window 4. As the humidity decreases, the humidity PID controller 52 sends a signal to the temperature PID controller 42 to decrease the heat input of the pre-heat burner 26. By monitoring the humidity and temperature, and allowing the humidity control loop 50 to provide adjusted temperature set points to the temperature control loop 40 only the minimum amount of heat necessary to maintain humidity within the optimal window 4 is used. This improves the overall atmospheric conditions within the paint spray booth while also reducing energy consumption.

While certain embodiments of the invention are described in detail above, the scope of the invention is not considered limited by such disclosure, and modifications are possible without departing from the spirit of the invention as evidenced by the following claims:

What is claimed is:

1. A system for maintaining optimal humidity and temperature in a clear coat paint booth, comprising:

an air supply unit providing forced air to the paint booth, the air supply unit having a pre-heat burner, said pre-heat burner positioned to heat air entering the air supply unit;

a temperature PID controller in electrical communication with said pre-heat burner, said temperature PID controller pre-programmed to make adjustments to the pre-heat burner to track an input temperature set point;

a temperature sensor in electrical communication with said temperature PID controller, said temperature sensor monitoring the temperature in said paint booth;

a humidity sensor monitoring the humidity in said paint booth; and a humidity PID controller in electrical communication with said humidity sensor and said temperature PID controller;

wherein, when the monitored humidity within said paint booth falls outside of an optimal window, the humidity PID controller is programmed to transmit an adjusted temperature set point to said temperature PID controller, which will override an existing temperature set point and cause said temperature PID controller to operate said pre-heat burner in a manner that moves the humidity level within said paint booth into said optimal window.

2. The system of claim 1, wherein said optimal window has a range of about 65% to about 75% humidity.

3. The system of claim 1, wherein an adjusted temperature set point will not exceed 75° F.

4. The system of claim 1, wherein a switch is interposed between said humidity PID controller and said temperature PID controller.

5. The system of claim 1, wherein said air supply unit further comprises a humidification media and a cooling coil.

6. The system of claim 1, wherein said humidity PID controller provides adjusted temperature set points to the temperature PID controller at pre-programmed intervals.

7. The system of claim 1, further comprising an inlet temperature sensor monitoring the temperature of air entering said air supply unit and in electrical communication with said temperature PID controller, and an inlet humidity sensor monitoring the humidity of air entering said air supply unit and in electrical communication with said humidity PID controller.

8. A system for maintaining an optimal environment in a paint booth, comprising:

an air supply unit providing forced air to the paint booth, the air supply unit having a pre-heat burner, said pre-heat burner positioned to heat air entering the air supply unit;

a temperature control loop comprising:

a temperature PID controller in electrical communication with said pre-heat burner, said temperature PID controller pre-programmed to make adjustments to the pre-heat burner to track an input temperature set point, and a temperature sensor in electrical communication with said temperature PID controller, said temperature sensor positioned at an outlet of said air supply unit so as to monitor the temperature in said paint booth;

a humidity control loop in electronic communication with said temperature control loop, including:

a humidity sensor positioned within said air supply unit so as to monitor the humidity in said paint booth, and a humidity PID controller in electronic communication with said humidity sensor and said temperature PID controller;

wherein, when the monitored humidity within said paint booth is outside an optimal window and the monitored temperature in said paint booth is within or below said optimal window, said humidity PID controller is programmed to transmit an adjusted temperature set point to said temperature PID controller, which will override an existing temperature set point and cause said temperature PID controller to operate said pre-heat burner in a manner that moves the humidity level within said spray booth into said optimal window.

9. The system of claim 8, wherein said optimal window has a range of about 65% to about 75% humidity.

10. The system of claim 8, wherein said optimal window has a temperature range of about 65° F. to about 75° F.

11. The system of claim 8, wherein an adjusted temperature set point will not exceed 75° F.

12. The system of claim 8, wherein a switch is interposed between said humidity PID controller and said temperature PID controller.

13. The system of claim 8, further comprising an inlet temperature sensor monitoring the temperature of air entering said air supply unit and in electrical communication with said temperature PID controller, and an inlet humidity sensor monitoring the humidity of air entering said air supply unit and in electrical communication with said humidity PID controller.

14. A method for maintaining an optimal environment in a paint booth, comprising:

providing an air supply unit for forcing air into the paint booth, said air supply unit having a pre-heat burner positioned to heat air entering said air supply unit;

providing a temperature control loop, said temperature control loop comprising:

a temperature PID controller in electrical communication with said pre-heat burner, said temperature PID controller pre-programmed to make adjustments to the pre-heat burner to track an input temperature set point, and a temperature sensor in electrical communication with said temperature PID controller, said temperature sensor positioned at an outlet of said air supply unit so as to monitor the temperature in said paint booth;

providing a humidity control loop in electrical communication with said temperature control loop, said humidity control loop comprising:

a humidity sensor positioned within said air supply unit so as to monitor the humidity in said paint booth, and a humidity PID controller in electrical communication with said humidity sensor and said temperature PID controller; and using said humidity PID controller to transmit an adjusted temperature set point to said temperature PID controller when the monitored humidity in said paint booth is outside an optimal window and when said monitored temperature is within or below said optimal window, so as to override an existing temperature set point and cause said temperature PID controller to operate said pre-heat burner to increase or decrease the temperature of air entering the air supply unit as necessary to move said humidity level within said paint booth into said optimal window.

15. The method of claim 14, wherein said optimal window has a range of about 65% to about 75% humidity.

16. The method of claim 14, wherein said optimal window has a temperature range of about 65° F. to about 75° F.

17. The method of claim 14, further comprising preventing said humidity PID controller from increasing the monitored temperature above 75° F.

18. The method of claim 14, wherein an adjusted temperature set point will not exceed 75° F.

19. The method of claim 14, wherein said humidity PID controller continues to transmit adjusted temperature set points to said temperature PID controller at pre-programmed intervals until the humidity level in said paint booth is within said optimal window.

20. The method of claim 14, further comprising interposing a switch between said temperature PID controller and said humidity PID controller.

* * * * *